US005186696A

United States Patent [19]

Pfefferle et al.

[11] Patent Number: 5,186,696

[45] Date of Patent: Feb. 16, 1993

[54] DOORWAY BAR SUPPORT AND OPERATING UNIT COMBINATION

[76] Inventors: Troy Pfefferle, 420 Perrie Dr., Elk Grove Village, Ill. 60007; Melvin J. Fein, 405 Di Lorenzo, Naperville, Ill. 60565

[21] Appl. No.: 674,233

[22] Filed: Mar. 25, 1991

[51] Int. Cl.[5] ..... A63B 1/00

[52] U.S. Cl. ..... 482/40; 482/38

[58] Field of Search ..... 482/38, 39, 40, 148; 472/118, 119, 120

[56] References Cited

U.S. PATENT DOCUMENTS

| | | | |
|---|---|---|---|
| 1,676,061 | 7/1928 | Strom | 482/39 |
| 3,502,326 | 3/1970 | Schaeffer | 482/40 |
| 3,937,463 | 2/1976 | Soisson | 472/118 |
| 4,974,836 | 12/1990 | Hirsch | 482/40 |

*Primary Examiner*—Stephen R. Crow
*Attorney, Agent, or Firm*—Ernest Kettelson

[57] ABSTRACT

A doorway bar support and operating unit combination in accordance with the present invention includes a two part cross bar assembly connected by a threaded shaft for spreading the bar assembly outwardly for frictional bearing engagement of pressure plate members on each outer end against the spaced apart upright members of a door frame. The pressure plate members include a receiving channel to receive therein the upright abutment strip along each upright member of the door frame against which the door abuts when swung to its closed position. Thus, the pressure plate members have a broad enough bearing surface to bear against the upright members of the door frame on both sides of the abutment strip, and to bear against the outer surface as well as side wall surfaces of the abutment strip itself which are snugly received in the receiving channel of each of the pressure plate members. Operating units operatively connected with the bar assembly in accordance with this invention include exercise equipment which fully developed adult athletes may safely use, playground type equipment such as gliders, teeter-totters, slides, swings and the like not only for small children but the support assembly is strong enough and safe enough for use by children of any age without fear that the pressure plate members and bar assembly in accordance with this invention would give away.

6 Claims, 8 Drawing Sheets

DOORWAY BAR SUPPORT AND OPERATING UNIT COMBINATION

BACKGROUND OF THE INVENTION

This invention relates to the field of supporting structures to support operational devices such as exercise equipment, for example to support an exercise bar; toys, for example to support a swing or teeter-totter; and the like. In particular, it relates to a supporting member which can be readily mounted in a doorway between the door jambs for use indoors and just as readily removed therefrom with no damage thereto as a result of such use.

Prior art devices in this field which are known to the inventors include those disclosed in the following United States patents:

U.S. Pat. No. 4,529,191 discloses a bar assembly for an open doorway, having contoured ends to clamp around the opposite upright members of the door jamb, a pair of wedge members screwed into the inwardly facing surfaces of such upright members, a pair of link members connected to the contoured ends of the bar assembly which are wedged into the pair of screwed-in wedge members, the bar assembly having a pair of outwardly projecting arms at each side extending from the contoured ends to the lateral cross bar, such outwardly projecting arms providing leverage when the cross bar is grasped and pulled downwardly causing the contoured ends to clamp the upright members tightly, which together with the wedged link members help to keep the bar assembly from moving downwardly within the open doorway when downward pressure is applied to the lateral cross bar.

U.S. Pat. No. 4,478,409 discloses a hanging chair suspended from mounting brackets secured to the side walls of a pair of spaced apart uprights, such as the uprights of a door jamb.

U.S. Pat. No. 4,364,558 discloses a punching bag apparatus supported on a laterally extending member secured to brackets installed on the spaced apart uprights of a door frame.

U.S. Pat. No. 4,077,403 discloses a telescoping cross bar extending across an open doorway, its opposite ends being supported by doorway riser tubes positioned adjacent the spaced apart upright members of a door frame.

U.S. Pat. No. 2,943,669 discloses a riding toy which can be mounted at the swinging outer edge of a door, by strap members secured to the door knob, spaced apart channel plates to receive the outer edge of the door therein, and a wedge member to wedge between such channel plates and the door to hold the toy more firmly in place on the outer swinging edge of the door.

U.S. Pat. No. 2,839,299 discloses a convertible toy which can be converted from a teeter-totter to a slide, and a cross bar held in an open doorway between the two upright members of a door frame by a pair of circular collars having a planar outer surface pressing against flat plates of soft rubber to sandwich between the collars and the upright members. There is no provision for receiving the vertical abutment strips against which the door abuts when in its closed position by the pair of circular collars, or by the flat plates of soft rubber, nor any structure that would enable them to extend on both opposite sides of such vertical abutment strips to bear against both opposite sides of each of the pair of spaced apart upright members.

U.S. Pat. No. 1,586,899 discloses a see-saw and mounting brackets to clamp on one of the upright members of a door frame.

U.S. Pat. No. 1,401,476 discloses a gymnastic apparatus comprising a one piece bar member extending between two upright members, which can be a door frame, a window frame, two parallel walls or the like, the one piece bar member having rods extending outwardly from each end to seat in respective ones of a pair of blocks, one of the rods being threaded to seat in a correspondingly threaded plate secured to one of the blocks. When rotated in one direction the threaded rod moves the blocks against their respective upright members. The blocks have resilient pads of rubber or felt on their outwardly facing surfaces to bear against the uprights. The blocks do not have any provision to receive the abutment strips of a doorway frame which extend vertically alongside each upright for the door to abut against when in its closed position.

U.S. Pat. No. 1,126,857 discloses a portable gymnastic apparatus comprising a cross bar in one embodiment and hand grips in another embodiment suspended between an open doorway by hook and clamp members secured to the upper cross beam of the door frame.

U.S. Pat. No. 250,738 discloses a portable gymnastic apparatus which includes a cross bar for mounting between the upright members of a door frame, and brackets screwed into or bolted to such uprights to receive and hold the ends of the cross bar.

The supporting bar assembly in accordance with the present invention is an improvement over those of the prior art. Among other things, it includes a pair of pressure plate members rotatably mounted at the outer ends of the bar members for frictional bearing engagement against the upright members of a door frame which include a receiving channel to receive the vertical abutment strips which extend along and project out from each of the upright members for the door to abut against when swung to its closed position. This structure enables the bearing surface of the pressure plate members to extend on both sides of such abutment strips, thereby providing a frictional bearing surface across the entire width of each of the upright frame members for greater frictional holding power. The receiving channel of each pressure plate member also has a planar bearing surface to itself bear against the abutment strip when received therein to provide still additional friction holding power. The side walls of the receiving channel furthermore are in sliding frictional engagement with the corresponding side walls of the abutment strips for even more frictional holding power, as well as to hold each of the pressure plate members and bar assembly itself from forward and backward movement relative to the upright members of the door frame. Thus, when someone is using an item suspended from the bar assembly which pulls forwardly of the open doorway in which the bar assembly is secured, or which pulls rearwardly thereof, the pressure plate members cannot be inadvertently pulled out of position forwardly or rearwardly since their receiving channels each have a corresponding one of the upright abutment strips held therein to prevent any such inadvertent movement out of position.

The pressure plate members of the bar assembly in accordance with this invention also include triangular reinforcing ribs, or gussets, to reinforce the bearing surfaces of the pressure plate members and prevent them from flexing or otherwise being distorted out of their full bearing engagement when great forces are applied to the cross bar members.

The bearing surfaces in accordance with this invention have friction enhancing material rigidly affixed thereto, such as relatively hard rubber or the like, which cannot tend to slip or "bunch up" as soft rubber and other non-rigid materials tend to do when very great sliding forces are applied to a friction bearing surface.

The supporting bar assembly in accordance with the present invention is uniquely adapted for use with operating items which require very great holding power of the cross bar members, such as exercise equipment for use by fully developed athletes having great physical strength as well as for use with playground type equipment such as gliders, swings and teeter-totters which can safely be used not only by very small children but by children of any age.

Further advantages of the supporting bar assembly and operating items in accordance with this invention will become apparent from the detailed description which follows.

SUMMARY OF THE INVENTION

It is an object of the invention to provide a support bar for operational devices such as exercise equipment, toys, sports items and the like which can be readily mounted across the open doorway in a home or other building and readily taken down after use without damage to the door frame or any part of the structure in which and to which it is secured.

DESCRIPTION OF PREFERRED EMBODIMENT

Figure 1:
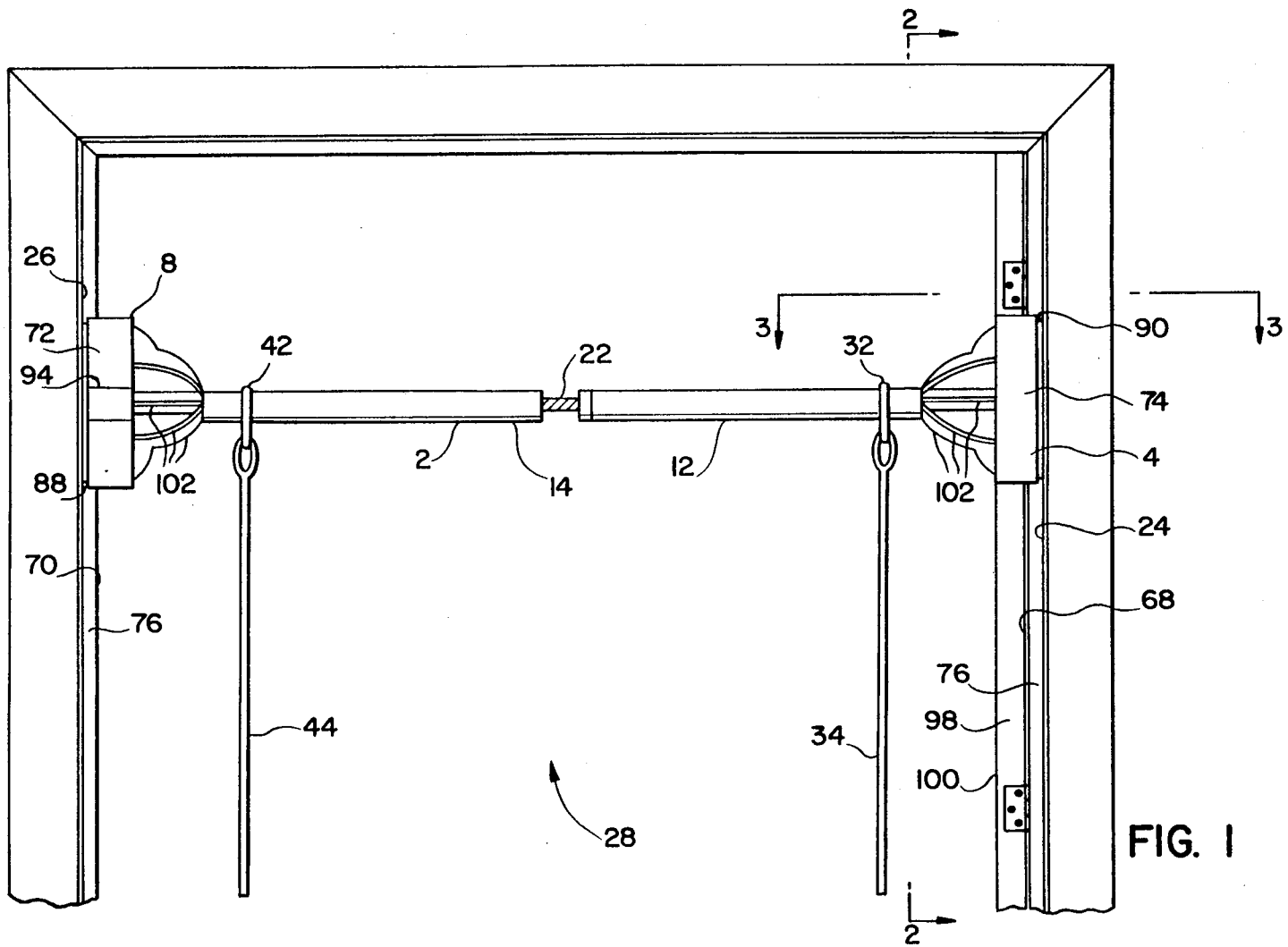
FIG. 1 is an elevation view of a doorway bar support in accordance with this invention shown in place within an open doorway.
Figure 2:
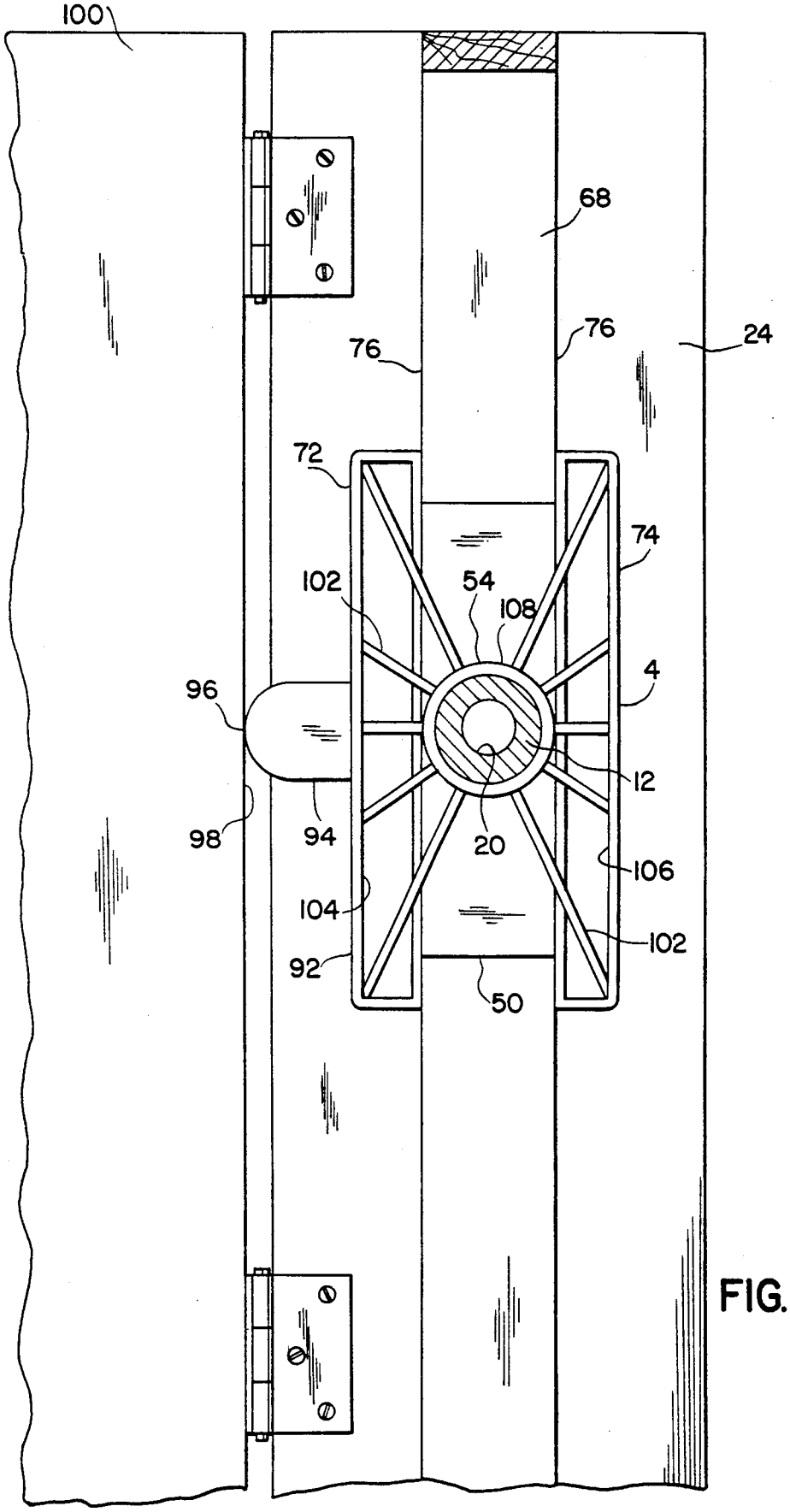
FIG. 2 is a section view taken on line 2—2 of FIG. 1.
Figure 3:
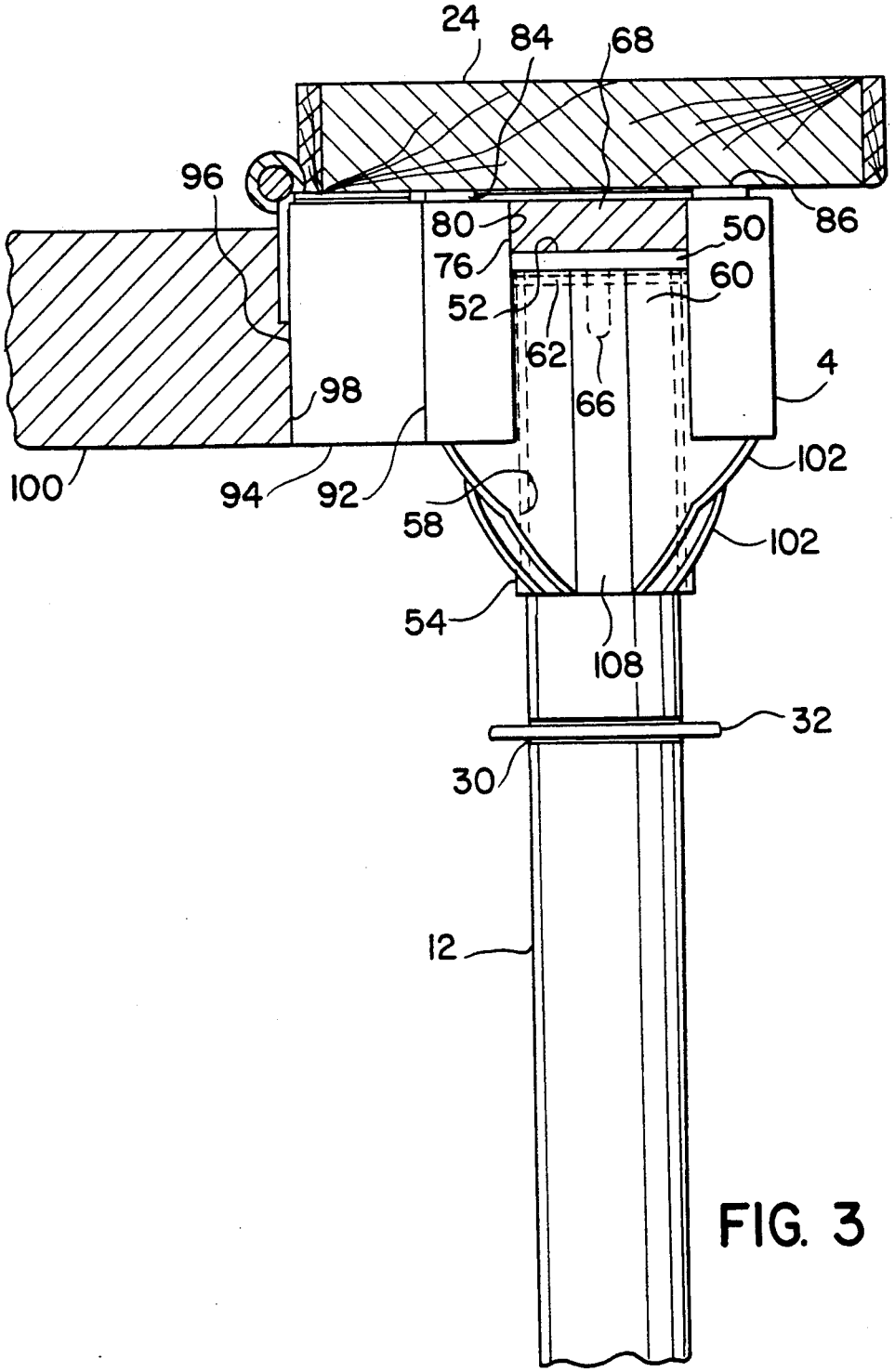
FIG. 3 is a section view taken on line 3—3 of FIG. 1.
Figure 4:
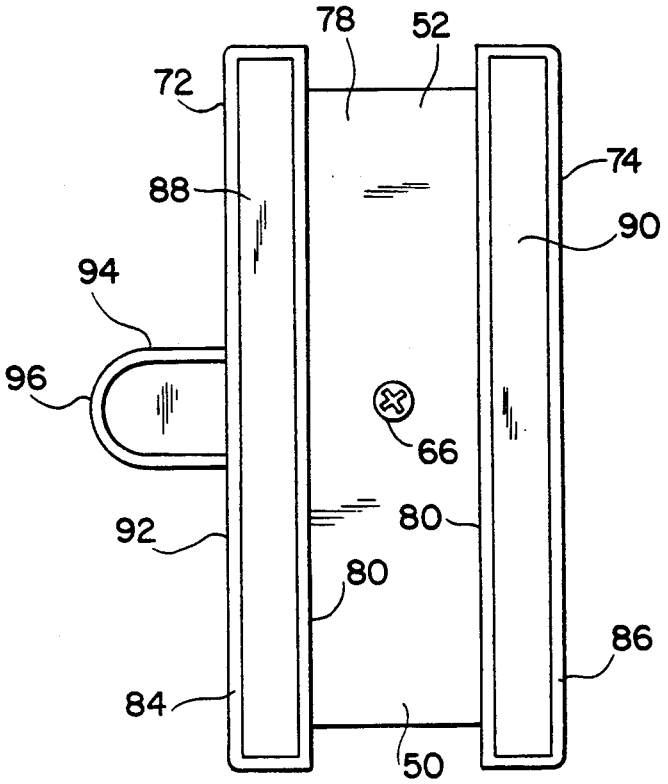
FIG. 4 is an end elevation view of one of the pressure plate members in accordance with this invention looking at its outwardly facing side.
Figure 5:
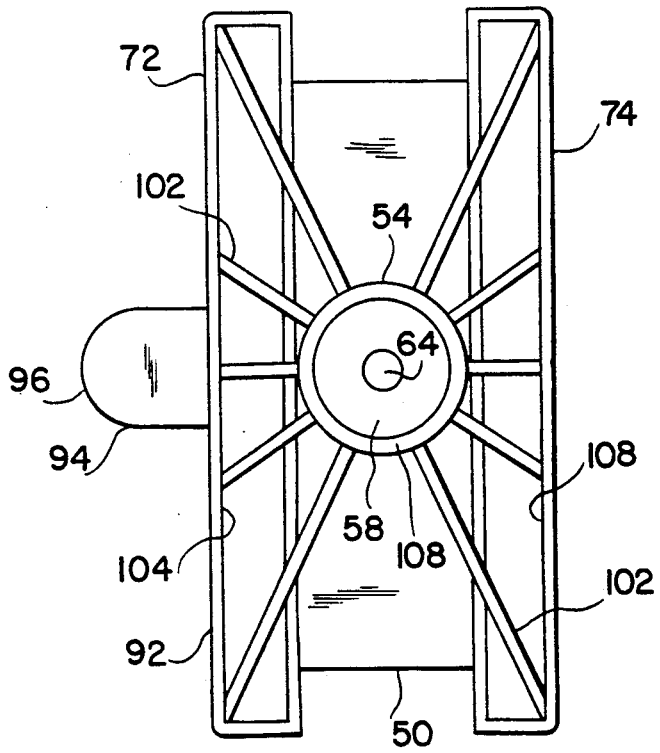
FIG. 5 is an end elevation view of the pressure plate member shown in FIG. 4 looking at its inwardly facing side.
Figure 6:
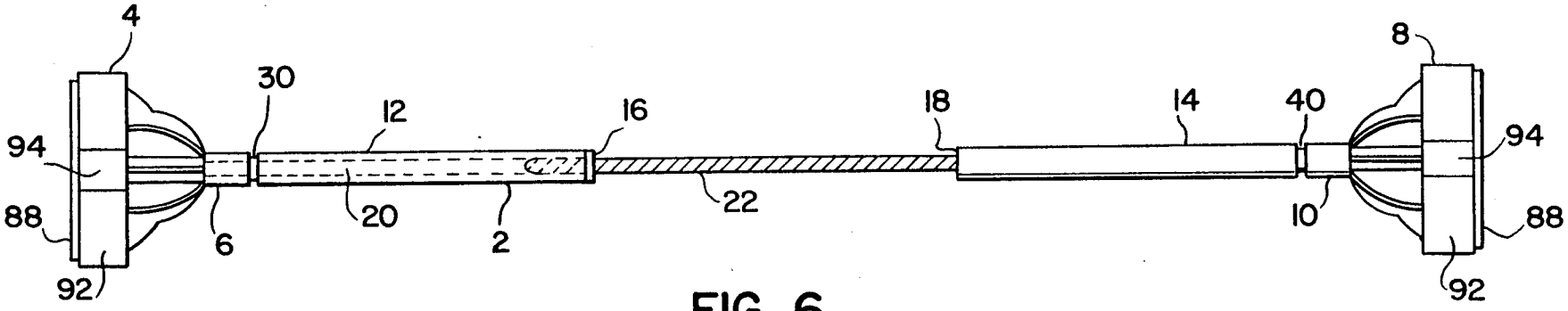
FIG. 6 is a side elevation view of a bar assembly in accordance with this invention, showing the threaded shaft of one bar member extended from the threaded bore of the other almost to its limit.

A doorway bar support and a useable or operational item supported thereby in accordance with this invention comprises an elongated cylindrical bar assembly 2 having a first pressure plate member 4 rotatably secured to one end 6 and a second pressure plate member 8 rotatably secured to the opposite end 10.

The cylindrical bar assembly 2 is a two part assembly comprising a first elongated cylindrical bar member 12 and a second elongated cylindrical bar member 14. The first bar member 12 has the first pressure plate member 4 rotatably secured to its outer end, and it extends inwardly thereof in the direction toward the second pressure plate member 8 but terminating short thereof at its inner end 16.

The second bar 14 has the second pressure plate member 8 rotatably secured to its outer end, and it extends inwardly thereof in the direction toward the first pressure plate member 4 but terminating short thereof at its inner end 18.

An internally threaded recess 20 extends inwardly of the first elongated bar member 12 from its inner end 16 to receive therein a corresponding externally threaded shaft 22 which extends axially from the inner end 18 of the second elongated bar member 14. The externally threaded shaft 22 is rigidly secured to bar member 14, so when received in the internally threaded recess 20 and threadedly engaged therewith, the bar member 14 may be rotated while the bar member 12 is held from rotation to move bar member 14 closer to bar member 12 when rotated in one direction and to move bar member 14 farther away from bar member 12 when rotated in the opposite direction of rotation.

The pressure plate members 4 and 8 may thus be moved farther apart when positioned against the respective upright members 24 and 26 on opposite sides of an open doorway 28 to increase the pressure thereagainst of the respective pressure plate members 4 and 8. They may also be moved closer together by rotating bar member 14 in the opposite direction of rotation relative to bar member 12 to separate the pressure plate members 4 and 8 from the opposite side upright members 24 and 26 of the doorway 28 and remove the bar assembly therefrom.

Each bar member 12 and 14 are preferably about thirteen inches in length with an outer diameter of about an inch and a half. They are preferably made of high strength aircraft aluminum, but the invention is not limited to such material. The externally threaded shaft is preferably about thirteen inches in length also with a diameter of about three-fourths of an inch. The invention is not limited to such dimensions, but such dimensions are appropriate for use in doorways having lateral openings from about twenty nine to thirty four inches and to support weights up to about four hundred pounds.

A first annular ring positioning groove 30 is provided around the first bar member 12 near its outer end and spaced apart inwardly from the first pressure plate member 4 about an inch to receive a first oversize connecting ring 32 therein to position it on the bar and hold it from lateral movement thereon when a rope 34 or other connecting member of an operating unit such as a swing 36 is connected thereto.

A second annular ring positioning groove 40 is provided around the second bar member 14 near its outer end and spaced apart inwardly from the second pressure plate member 8 about an inch to receive a second oversize connecting ring 42 therein to hold it on the bar and hold it from lateral movement thereon when the other rope 44 or connecting member of the swing 36 or other operating unit is connected thereto.

An elongated cover tube 46 having an oversize diameter relative to the outer diameter of the bar members 12 and 14 so it may slide thereon, is mounted on the bar members to cover the portion of threaded shaft 22 which extends between the inner end 16 of bar member 12 and the inner end 18 of bar member 14. The length of the cover tube 46 is sufficient to overhang portions of bar members 12 and 14 inwardly from their inner ends when they have been spread apart to the maximum useable width of the bar assembly 2. By way of illustration and example, a preferable length of the elongated cover tube 46 is eleven inches, but it is not limited to such dimension.

Each of the pressure plate members 4 and 6 are identical, so in the interest of space only pressure plate member 4 will be described in detail. It comprises a rigid body portion including a rectangular plate 50 having a planar surface 52 facing outwardly and a cylindrical sleeve 54 extending inwardly from its opposite surface 56. The cylindrical sleeve 54 has a cylindrical recess or socket 58 to receive the outer end 60 and end wall 62 of cylindrical bar member 12 in the case of pressure plate member 4 and of cylindrical bar member 14 in the case of identical pressure plate member 8. A screw aperture 64 extends through the rectangular plate 50 to receive a securing screw 66 therethrough for threaded insertion into the end wall 62 of the bar members 12 and 14 to hold the respective pressure plate members 4 and 8 thereto.

The diameter of the cylindrical socket 58 of the sleeve 54 is sufficiently large relative to the diameter of the outer end 60 of bar members 12 and 14 to permit free rotation of the respective pressure plate members 4 and 8 thereon.

The width or lateral dimension of the rectangular plate 50 corresponds to the width of each of the upright abutment strips 68 and 70 secured to the upright members 24 and 26 of the doorway 28.

A pair of elongated ribs 72 and 74 are positioned along each opposite longitudinally extending side of the rectangular plate 50 and extend outwardly therefrom a distance corresponding to the thickness of each of the abutment strips 68 and 70, defined by the abutment strip side walls 76 and their lateral dimension outwardly from the upright members 24 and 26 to which they are secured.

The elongated ribs 72 and 74 extending outwardly from opposite side edges of rectangular plate 50 form an elongated receiving channel 78 to receive the facing portion of abutment strips 68 and 70 therein. The inwardly facing portions of the elongated ribs 72 and 74 which form the side walls 80 of the elongated channel 78 have substantially the same lateral dimension from the surface 52 of plate 50 outwardly where they terminate at the outwardly facing planar surfaces 84 and 86 of the ribs 72 and 74, as the corresponding lateral dimension of the side walls 76 of the abutment strips 68 and 70.

Elongated strips 88 and 90 of relatively rigid or hard rubber or other friction enhancing material are glued or otherwise rigidly secured to the outwardly facing planar surfaces 84 and 86 of the elongated ribs 72 and 74.

The outwardly facing side wall 92 of elongated rib 72 includes an outwardly projecting door stop 94 whose outer free end 96 bears against the hinged vertical end wall 98 of the door 100 when in its fully open position and when pressure plate member 4 is in place against the upright member 24 on the side of the open doorway to which the door 100 is hinged.

At such time, the vertical abutment strip 68 on upright member 24 is received in the receiving channel 78 of the pressure plate member 4, and at the opposite end of the bar assembly 2, the vertical abutment strip 70 on upright member 26 on the opposite side of the open doorway is received in the receiving channel 78 of the pressure plate member 8.

The elongated bar members 12 and 14 which are adjustably connected by externally threaded shaft 22 of bar member 14 seated in the internally threaded recess 20 of bar member 12, are then rotated in the opposite directions relative to each other which causes bar members 12 and 14 to spread farther apart until the pressure plates 4 and 8 are abutting tightly against the respective upright members 24 and 26 of the open doorway 28. The elongated rubber strips 88 and 90 on the outwardly facing planar surfaces 84 and 86 of the pressure plates 4 and 8 are at such time in tight frictional contact with the respective upright members 24 and 26 to frictionally hold the bar assembly 2 from upward or downward movement within the open doorway 28.

The vertical abutment strips 68 and 70 of the upright members 24 and 26 received in respective ones of the receiving channels 78 of the pressure plates 4 and 8 hold the bar assembly 2 from forward or rearward movement when secured in position within the open doorway 28 as described above.

At such time, the outer free end 96 of the door stop 94 on pressure plate 4 is in bearing engagement against the hinged vertical end wall 98 of the open door 100 to prevent closing of the door while the bar assembly 2 is in place for use within the open doorway 28.

In a typical inside door installation of a residence, the distance between the hinged vertical end wall 98 of the door 100 when in its fully open position and the side wall 76 facing it of the abutment strip 68 is about two and one-eighth inches. Thus the outer free end 96 of the door stop 94 on the pressure plates 4 and 8 (both of which are identical) is spread apart outwardly from the side wall 80 of channel 78 nearest door stop 94 an equal distance of about two and one-eighth inches. When pressure plate 4 is thus in place against upright member 24 with its vertical abutment strip 68 received in channel 78 of pressure plate 4, the elongated rib 72 and door stop 94 which projects outwardly therefrom fill the space between the abutment strip 68 and the hinged end wall 98 of the door 100 with the free end 96 of the door stop 94 bearing against the door end wall 98, which prevents closure of the door 100.

The door stop 94 and its free end 96 have a horizontal or lateral dimension which is at least as great as the corresponding horizontal or lateral dimension of the door end wall 98 to provide maximum abutment surface to prevent moving the door 100 from its fully open position to its closed position.

The sleeve 54 and socket 58 of the pressure plate members extend inwardly from the plate 50 a distance of about two inches in a preferred embodiment of the invention, whereby about two inches of the outer ends of the bar members 12 and 14 are received in respective ones of the sockets 58 of pressure plate members 4 and 8. A plurality of reinforcing gussets 102 are provided between the inwardly facing surfaces 104 and 106 of the elongated ribs 72 and 74 of each pressure plate member and the cylindrical wall 108 of the sleeve 54. The reinforcing gussets 102 hold and reinforce the ribs 72 and 74 against inward movement when forced outwardly into tight pressing engagement against the upright members 24 and 26 of the open doorway 28. The reinforcing gussets 102 enable the pressure plate members 4 and 8 to hold their shape and position and their tight frictional engagement with the upright members 24 and 26.

When the elongated rubber strips 88 and 90 on the outer surfaces 84 and 86 of the ribs 72 and 74 are in frictional bearing engagement against respective ones of the upright members 24 and 26 of the open doorway 28, the rectangular plate 50, which forms the floor of the receiving channel 78, is also in frictional bearing engagement against respective ones of the abutment strips 68 and 70 received in channel 78 of respective ones of the pressure plate members 4 and 8, to provide an additional friction retaining means.

The inwardly facing surfaces of the ribs 72 and 74 which form the side walls 80 of the channel 78 are also in sliding frictional engagement against the facing side walls 76 of the abutment strips 68 and 70, to provide a still further friction retaining means to prevent the pressure plate members 4 and 8 from sliding downward and to hold the bar assembly 2 securely in place.

Figure 7:
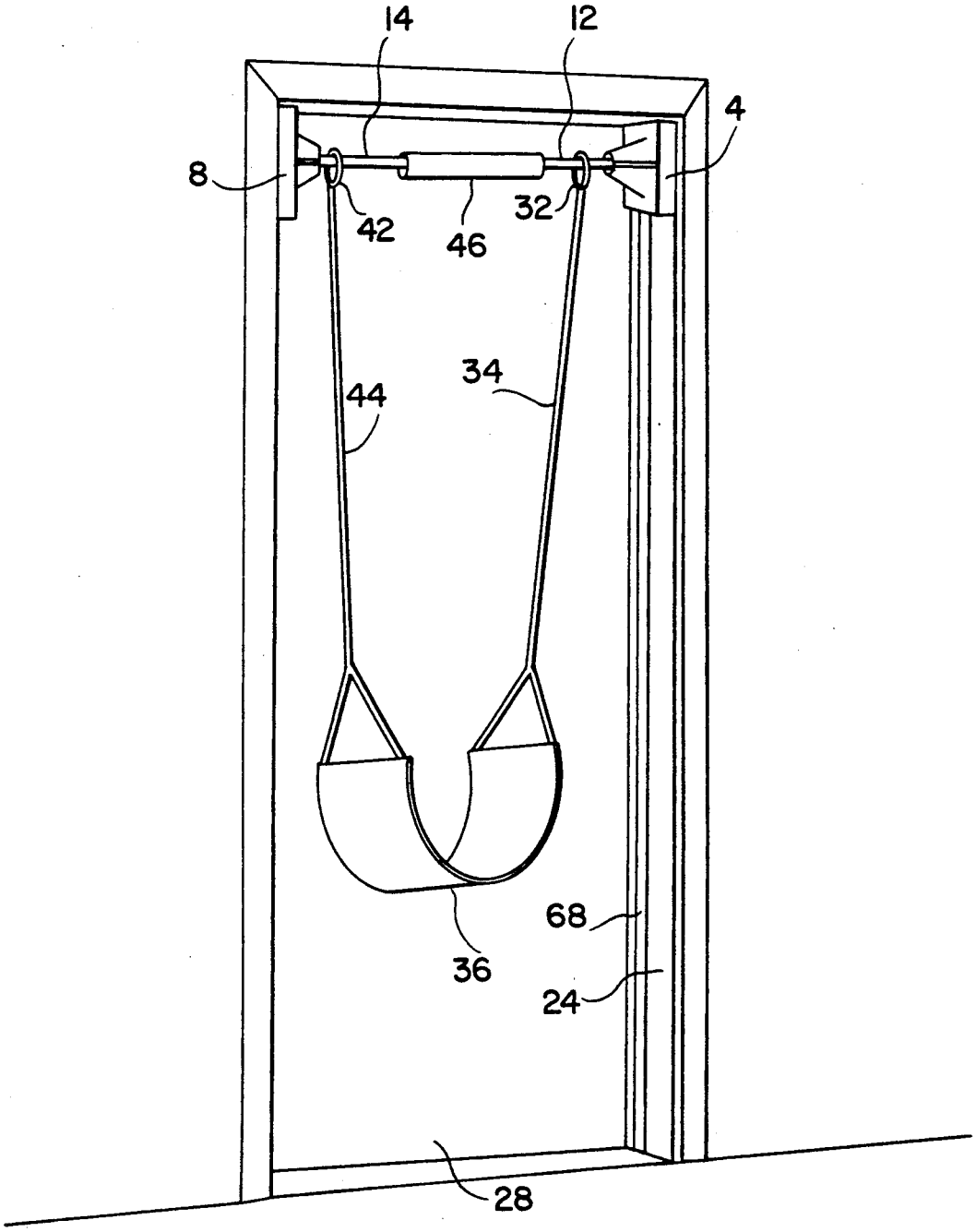
FIG. 7 is a perspective view of the doorway bar support and swing in accordance with this invention secured in place for use within an open doorway.

The bar assembly 2 in accordance with this invention may be used with and to support a number of different types of operating units besides the swing 36 illustrated in FIG. 7.

Figure 8:
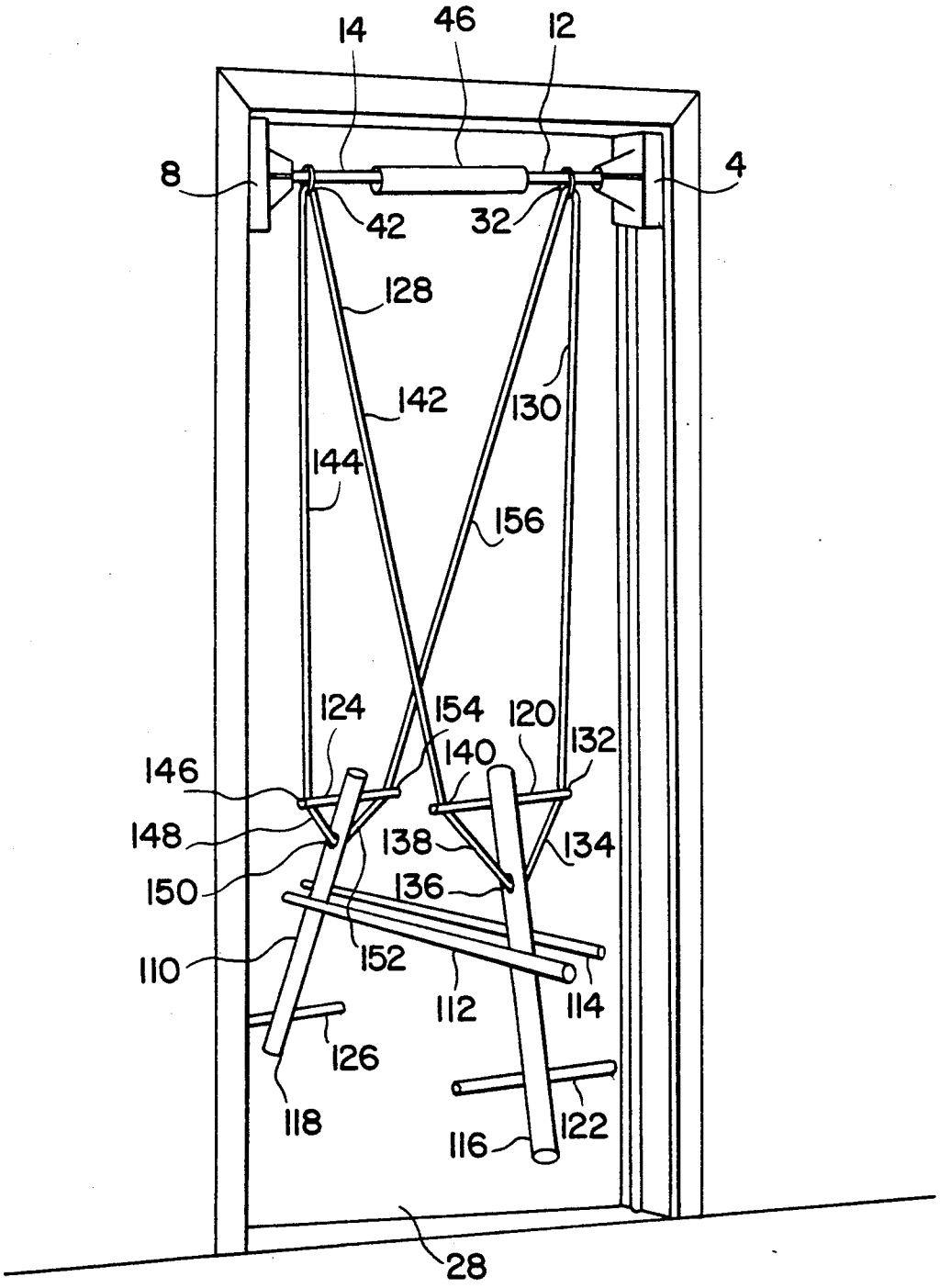
FIG. 8 is a perspective view of the doorway bar support and glider in accordance with this invention secured in place for use within an open doorway.

A children's glider 110 is shown in FIG. 8, on which two children facing oppositely with their backs to each other may be seated on the seating bars 112 and 114. A first pump bar 116 is pivotally mounted between the seating bars 112 and 114 near one end thereof, and a second pump bar 118 is pivotally mounted between the seating bars 112 and 114 near the opposite end thereof.

A first handle bar 120 extends laterally from the first pump bar 116 near its upper end for one of the seated children facing it to grasp. A first foot rest bar 122 extends laterally from the first pump bar 116 near its lower end on which the child facing it may place his feet.

A second handle bar 124 extends laterally from the second pump bar 118 near its upper end for the other one of the seated children facing it to grasp. A second foot rest bar 126 extends laterally from the second pump bar 118 near its lower end on which the other child facing it may place his feet.

The glider 110 is suspended from the bar assembly 2 for operation by a suspension assembly 128, comprising a first rope length 130 looped through and extending from the oversize ring 32 downwardly to outer end 132 of the first handle bar 120, through an aperture thereof where a second rope length 134 extends downwardly at a sharper angle to and through an aperture 136 of the first pump bar 116 spaced apart inwardly thereof from the handle bar 120 in the direction toward the foot rest bar 122, after which a third rope length 138 extends upwardly at an equivalent sharp angle to the other outer end 140 of the first handle bar 120, through an aperture thereof whereupon a fourth rope length 142 extends upwardly at a less sharp angle to the oppositely positioned oversize ring 42 through which it is looped.

The glider suspension assembly 128 then includes a fifth rope length 144 looped through oversize ring 42 extending downwardly to outer end 146 of the second handle bar 124, through an aperture thereof where a sixth rope length 148 extends downwardly at a sharper angle to and through an aperture 150 of the second pump bar 118 spaced apart inwardly thereof from the handle bar 124 in the direction toward the foot rest bar 126, after which a seventh rope length 152 extends upwardly at an equivalent sharp angle to the other outer end 154 of the second handle bar 124, through an aperture thereof whereupon an eighth rope length 156 extends upwardly at a less sharp angle to the first oversize ring 32 through which it is looped to join the first rope length 130.

With this suspension assembly 128 suspended from the bar assembly 2 secured in place in the open doorway 28, the glider may be moved back and forth through the open doorway by alternately pushing and pulling on the handle bars 120 and 124 as well as alternately pushing against the foot rest bars 122 and 126.

The bar assembly 2 may be positioned across the open doorway 28 at a lower level, and a teeter-totter board can be pivotally mounted thereon.

Figure 9:
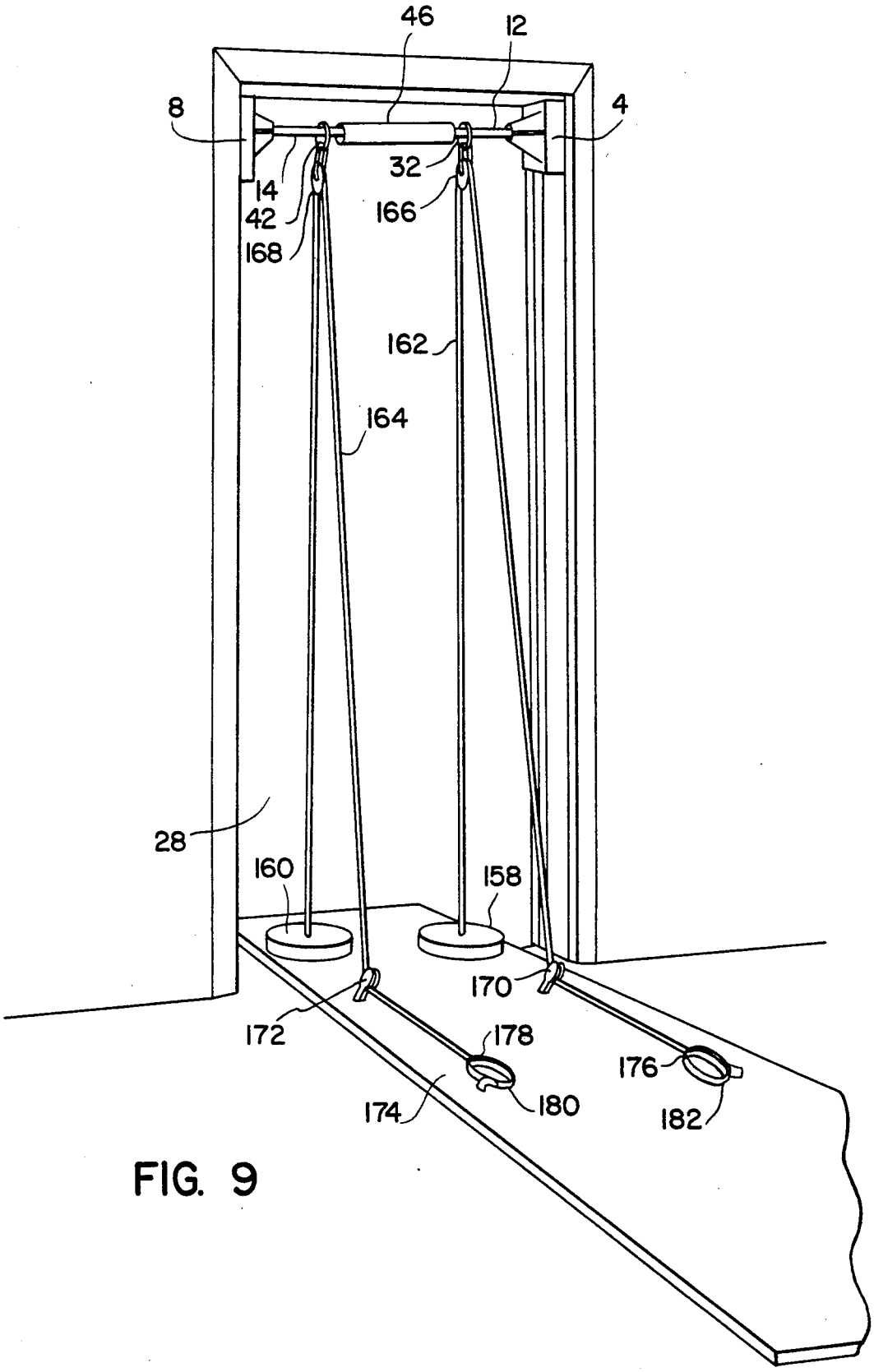
FIG. 9 is a perspective view of the doorway bar support and exercise apparatus in accordance with this invention secured in place for use within an open doorway.

The invention also encompasses exercise equipment operationally suspended in the open doorway 28, such as that shown in FIG. 9. A pair of weights 158 and 160 are suspended by exercise ropes 162 and 164 from pulleys 166 and 168 which are secured respectively to the rings 32 and 34 on the bar assembly 2. The ropes 162 and 164 extend through and downwardly from pulleys 166 and 168 to a second pair of pulleys 170 and 172 bolted to the exercise platform 174, through such pulleys and outwardly therefrom to terminate at connecting ends 176 and 178. In FIG. 9, a pair of ankle shackles 180 and 182 are shown connected to the connecting end 176 and 178 of the exercise ropes 162 and 164 which can be secured to the ankles of a user. As he moves his legs forward with the ankle shackles secured thereto, the exercise ropes extending through the pulleys raise the weights 158 and 160 thereby providing a convenient indoor exercise apparatus which can be quickly installed within the open doorway of the user's home when he desires to exercise and just as quickly taken down and put away when he is through exercising.

Other exercise items can be connected to the connecting ends 176 and 178 of the exercise ropes 162 and 164 to exercise other parts of the body. A hand grasp bar for example may be connected across the connecting ends 176 and 178 for a user to grasp with his hands for exercising the muscles in his arms and back.

We claim:

1. A laterally extending support assembly for support between a pair of spaced apart upright members and an operating unit operationally supported thereby, comprising an adjustable elongated structure having a first end facing outwardly in one direction and a second end facing outwardly in the opposite direction, said elongated structure including adjustment means to move said first and second ends farther apart when adjusted one way and closer together when adjusted a second way, a first pressure plate member at said first end of said adjustable elongated structure, a second pressure plate member at said second end of said adjustable elongated structure, each of said pressure plate members including holding means to hold them in place against respective ones of said pair of spaced apart upright members, said holding means including first friction holding means having a first planar surface extending in a first plane to frictionally bear against a first planar portion of said upright members and second friction holding means having a second planar surface extending in a second plane to bear against a second planar portion of said upright member, said second plane in which said second planar surface of said second friction holding means extends being positioned apart from said first plane in which said first planar surface of said first friction holding means extends, wherein said adjustable elongated structure includes a first elongated bar member, an externally threaded shank extending therefrom, a second elongated bar member, an internally threaded recess therein and opening to an end thereof to receive said externally threaded shank of said first bar member, said externally threaded shank and said internally threaded recess comprising said adjustment means to move said first and second ends of said adjustable elongated structure farther apart when rotated in one direction relative to each and closer together when rotated in the opposite direction relative to each other, wherein said first and second elongated bar members are cylindrical, said first elongated bar member includes an outer end opposite from the end from which its externally threaded shank extends, said second elongated bar member includes an outer end opposite from the end to which its internally threaded recess opens, said pressure plate members include a body portion, a first cylindrical socket in said body portion of said first pressure plate member to receive said outer end of said first elongated bar member, a second cylindrical socket in said body portion of said second pressure plate member to receive said outer end of said second elongated bar member, said first and second cylindrical bar members being rotatable within respective ones of said first and second cylindrical sockets of said first and second pressure plate members and secured thereto.

2. A laterally extending support assembly for support between a pair of spaced apart upright members and an operating unit operationally supported thereby, comprising an adjustable elongated structure having a first end facing outwardly in one direction and a second end facing outwardly in the opposite direction, said elongated structure including adjustment means to move said first and second ends farther apart when adjusted one way and closer together when adjusted a second way, a first pressure plate member at said first end of said adjustable elongated structure, a second pressure plate member at said second end of said adjustable elongated structure, each of said pressure plate members including holding means to hold them in place against respective ones of said pair of spaced apart upright members, said holding means including first friction holding means having a first planar surface extending in a first plane to frictionally bear against a first planar portion of said upright members and second friction holding means having a second planar surface extending in a second plane to bear against a second planar portion of said upright member, said second plane in which said second planar surface of said second friction holding means extends being positioned apart from said first plane in which said first planar surface of said first friction holding means extends, wherein said operating unit includes connecting means to connect it to said adjustable elongated structure when supported between said pair of spaced apart upright members, operating means to enable a user to move said operating unit between at least a first position and a second position, said operating means when operated by said user applying force on said laterally extending support assembly in a downward direction relative to said spaced apart upright members, in a forward direction forward thereof and in a rearward direction rearward thereof, said holding means including third abutment holding means to abut against an abutting surface of said upright members to hold said pressure plate members and said laterally extending support assembly from movement in said forward and rearward directions when said forces are applied on said laterally extending support assembly in said forward and rearward directions, wherein each of said pressure plate members include a body portion, said body portion having an outwardly facing planar surface comprising said first planar surface of said first friction holding means, a receiving recess in said body portion opening to said outwardly facing planar surface, said receiving recess including a pair of spaced apart planar side walls, said spaced apart planar side walls of said receiving recess comprising said third abutment holding means of said holding means to abut against an abutting surface of said upright members received in said receiving recess to hold said pressure plate members and said laterally extending support assembly from movement in said forward and rearward directions when said forces are applied on said laterally extending support assembly in said forward and rearward directions.

3. A laterally extending support assembly for support between a pair of spaced apart upright members and an operating unit operationally supported thereby, comprising an adjustable elongated structure having a first end facing outwardly in one direction and a second end facing outwardly in the opposite direction, said elongated structure including adjustment means to move said first and second ends farther apart when adjusted one way and closer together when adjusted a second way, a first pressure plate member at said first end of said adjustable elongated structure, a second pressure plate member at said second end of said adjustable elongated structure, each of said pressure plate members including holding means to hold them in place against respective ones of said pair of spaced apart upright members, said holding means including first friction holding means having a first planar surface extending in a first plane to frictionally bear against a first planar portion of said upright members and second friction holding means having a second planar surface extending in a second plane to bear against a second planar portion of said upright member, said second plane in which said second planar surface of said second friction holding means extends being positioned apart from said first plane in which said first planar surface of said first friction holding means extends, wherein each of said pressure plate members include a body portion, said body portion having an outwardly facing planar surface comprising said first planar surface of said first friction holding means, said outwardly facing planar surface extending in a plane which extends in a direction normal to the central axis of said adjustable elongated structure and which comprises said first plane in which said first planar surface extends, a receiving recess in said body portion opening to said outwardly facing planar surface, said receiving recess including a pair of spaced apart planar side walls, a planar inner end wall of said recess extending between said pair of spaced apart planar side walls of said recess and substantially normal thereto, said planar inner end wall of said recess comprising said second planar surface of said second friction holding means, said planar inner end wall of said recess extending in a plane which extends in a direction normal to the central axis of said adjustable elongated structure and which comprises said second plane positioned apart from said first plane, wherein said outwardly facing planar surface of each of said pressure plate members includes a first elongated planar surface which extends along one side of said receiving recess, a first elongated friction enhancing member rigidly secured to said body portion having an outwardly facing planar surface spaced apart outwardly from said first elongated planar surface a sufficient distance for friction enhancing engagement against said spaced apart upright members when said outwardly facing planar surface of said pressure plate members is placed in facing engagement therewith, a second elongated planar surface which extends along the opposite side of said receiving recess, a second elongated friction enhancing member rigidly secured to said body portion having an outwardly facing planar surface spaced apart outwardly from said second elongated planar surface a sufficient distance for friction enhancing engagement against said spaced apart upright members when said outwardly facing planar surface of said pressure plate members is placed in facing engagement therewith.

4. A laterally extending support assembly for support between a pair of spaced apart upright members and an operating unit operationally supported thereby, comprising an adjustable elongated structure having a first end facing outwardly in one direction and a second end facing outwardly in the opposite direction, said elongated structure including adjustment means to move said first and second ends farther apart when adjusted one way and closer together when adjusted a second way, a first pressure plate member at said first end of said adjustable elongated structure, a second pressure plate member at said second end of said adjustable elongated structure, each of said pressure plate members including holding means to hold them in place against respective ones of said pair of spaced apart upright members, said holding means including first friction holding means having a first planar surface extending in a first plane to frictionally bear against a first planar portion of said upright members and second friction holding means having a second planar surface extending in a second plane to bear against a second planar portion of said upright member, said second plane in which said second planar surface of said second friction holding means extends being positioned apart from said first plane in which said first planar surface of said first friction holding means extends, wherein each of said pressure plate members include a body portion, said body portion having an outwardly facing planar surface comprising said first planar surface of said friction holding means, a plurality of reinforcing ribs extending from said outwardly facing planar surface of said body portion inwardly thereof to support said outwardly facing planar surface and hold it from deflection inwardly when it is pressed against the facing portion of said pair of upright members.

5. A laterally extending support assembly for support between a pair of spaced apart upright members and an operating unit operationally supported thereby, comprising an adjustable elongated structure having a first end facing outwardly in one direction and a second end facing outwardly in the opposite direction, said elongated structure including adjustment means to move said first and second ends farther apart when adjusted one way and closer together when adjusted a second way, a first pressure plate member at said first end of said adjustable elongated structure, a second pressure plate member at said second end of said adjustable elongated structure, each of said pressure plate members including holding means to hold them in place against respective ones of said pair of spaced apart upright members, said holding means including first friction holding means having a first planar surface extending in a first plane to frictionally bear against a first planar portion of said upright members and second friction holding means having a second planar surface extending in a second plane to bear against a second planar portion of said upright member, said second plane in which said second planar surface of said second friction holding means extends being positioned apart from said first plane in which said first planar surface of said first friction holding means extends, wherein said adjustable elongated structure includes a first elongated bar member, an externally threaded shank extending therefrom, a second elongated bar member, an internally threaded recess therein and opening to an end thereof to receive said externally threaded shank of said first bar member, said externally threaded shank and said internally threaded recess comprising said adjustment means to move said first and second ends of said adjustable elongated structure farther apart when rotated in one direction relative to each and closer together when rotated in the opposite direction relative to each other, wherein said first elongated bar member includes a first annular positioning groove to receive and hold in position thereon a first connecting member to connect a said operating unit to said laterally extending support assembly, including said first connecting member, said second elongated bar member includes a second annular positioning groove to receive and hold in position thereon a second connecting member to connect a said operating unit to said laterally extending support assembly, including said second connecting member.

6. A laterally extending support assembly for support between a pair of spaced apart upright members and an operating unit operationally supported thereby as set forth in claim 5, wherein said first and second connecting members each comprise a ring member, said ring member having a diameter greater than the cross-sectional dimension of said first and second elongated bar members on which they are positioned.

* * * * *